United States Patent [19]

Inagaki et al.

[11] 4,273,848

[45] Jun. 16, 1981

[54] ORIENTED MAGNETIC TONER

[75] Inventors: Sanji Inagaki; Koji Nagai; Hiromi Kameda, all of Itami, Japan

[73] Assignee: Minolta Camera Kabushiki Kaisha, Japan

[21] Appl. No.: 17,535

[22] Filed: Mar. 5, 1979

[30] Foreign Application Priority Data

Mar. 14, 1978 [JP] Japan ..... 53-28893

[51] Int. Cl.[3] ..... G03G 9/14

[52] U.S. Cl. ..... 430/107; 430/109; 430/111; 430/903

[58] Field of Search ..... 430/107, 109, 111, 120, 430/903

[56] References Cited

U.S. PATENT DOCUMENTS

| | | | |
|---|---|---|---|
| 3,639,245 | 1/1972 | Nelson | 430/903 |
| 3,909,258 | 9/1975 | Kotz | 430/122 |
| 4,082,681 | 4/1978 | Takayama et al. | 430/109 |
| 4,176,078 | 11/1979 | Lu | 430/109 |

FOREIGN PATENT DOCUMENTS

| | | | |
|---|---|---|---|
| 51-26046 | 3/1976 | Japan | 430/122 |
| 51-40137 | 4/1976 | Japan | 430/107 |
| 52-67330 | 6/1977 | Japan | 430/122 |

*Primary Examiner*—Roland E. Martin, Jr.
*Assistant Examiner*—John L. Goodrow
*Attorney, Agent, or Firm*—Wenderoth, Lind & Ponack

[57] ABSTRACT

A particulate magnetic toner for use in a process for developing latent electrostatic images to toner images with a magnetic brush consists predominantly of a magnetic material and a resin of insulating properties. Each toner particle has a portion containing the magnetic material, said material extending through the particle and at least exposed on opposing surfaces of each toner particle to oppose the magnetic materials of other toner particles.

3 Claims, 5 Drawing Figures

ORIENTED MAGNETIC TONER

BACKGROUND OF THE INVENTION

This invention relates to a magnetic toner for use in a process for developing latent electrostatic images to toner images with a magnetic brush.

Developers comprising a non-magnetic toner of insulating properties and a magnetic carrier admixed therewith have heretofore been in wide use for the above-mentioned developing process. The magnetic carrier functions to triboelectrify the non-magnetic toner by frictional contact therewith, attracts the toner onto the surfaces of carrier particles to carry the toner to the developing station and serves as a developing electrode. However, the carrier, which is not consumed by development, becomes progressively degraded or the ratio of the toner to the carrier varies, with consequent adverse effects on the developing process.

To overcome this problem, it has been proposed in recent years to use a one-component developer containing no carrier and consisting only of a magnetic toner which per se incorporates a magnetic material, or to use a two-component developer comprising a non-magnetic insulating toner and a magnetic toner admixed therewith, serving as a toner and also as a carrier.

The magnetic toner contained in the one-component developer generally must have a volume resistivity of up to $10^8$ ohm-cm to meet the developing requirements, with the resulting problem that the toner images developed can not be transferred to copy paper efficiently or free of disturbance of the image. Thus such toner is not usable for plain paper copiers (PPC) which appear to be copiers of the ideal type. On the other hand, the magnetic toner, when having a volume resistivity of above $10^8$ ohm-cm, fails to achieve a high developing efficiency although permitting efficient image transfer and is not suitable for developing latent electrostatic images of low potential. It may be attempted to achieve an improved developing efficiency with the use of a magnet of reduced magnetic force for the magnetic brush developing unit, but this gives rise to many adverse effects. In either case, therefore, the toner is still unfit for use in PPC.

Additionally magnetic toners adapted for use in the one- and two-component developers contain a resin which renders the toner less flowable or conveyable than conventional magnetic carriers. An increased amount of magnetic material, if used in the toner to eliminate this drawback, will result in reduced fixing properties, whereas an attempt to afford enhanced fixing properties will lead to lower flowability or conveyability. The use of the toner thus inevitably involves the sacrifice of either the fixing properties or the flowability (conveyability) of the developer.

It has therefore been desired to eliminate the difficulties which still remain to be overcome despite the attempts heretofore made to solve the foregoing problems.

SUMMARY OF THE INVENTION

The main object of this invention is to provide a novel and very useful magnetic toner.

Another object of this invention is to provide a magnetic toner which is usable for the magnetic brush developing process free of the above problems heretofore experienced.

Another object of this invention is to provide a magnetic toner which permits satisfactory transfer of toner images.

Another object of this invention is to provide a magnetic toner which is outstanding in fixing properties and flowability or conveyability.

Still another object of this invention is to provide a magnetic toner suited for use in PPC.

These and other objects of this invention can be fulfilled by a magnetic toner useful for the magnetic brush developing process for developing latent electrostatic images to toner images, the magnetic toner being in the form of particles and consisting predominantly of a magnetic material and a resin of insulating properties, each of the toner particles having a portion containing the magnetic material, extending through the particle and at least exposed on opposint surfaces of each particle so as to oppose the magnetic materials exposed on the surface of the other toner particles.

Unlike the conventional magnetic toners containing a magnetic material uniformly dispersed throughout the entire particles, the magnetic toner particles of this invention each have a portion concentrically containing a magnetic material and disposed in a direction within the toner particle. Because of this structure, the toner exhibits a relatively low resistivity during development while showing a relatively high resistivity during the transfer of toner images, consequently fulfilling the foregoing objects when used in the one-component and two-component developers described above.

These and other objects, advantages and features of the invention will become apparent from the following description thereof when read in conjunction with the accompanying drawings which illustrate exemplary embodiments of the invention.

BRIEF DESCRIPTION OF THE DRAWINGS

In the following description, like parts are designated by like reference numbers throughout the several diagrams of the attached drawings.

DETAILED DESCRIPTION OF THE INVENTION

Figure 1A:
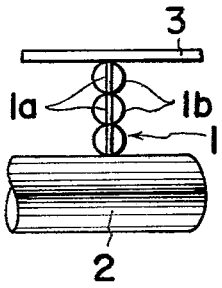
FIGS. 1(*a*), (*b*) and (*c*) schematically depict the behavior of magnetic toner particles of this invention during development and the transfer of toner images.
Figure 1B:
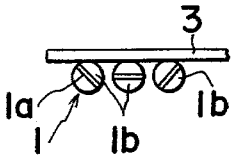
Figure 1C:
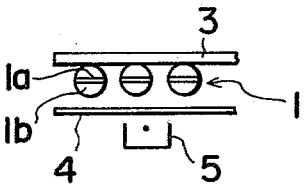

As shown in FIG. 1 for example, magnetic toner particles 1 of this invention each have a portion or layer 1*a* containing a magnetic material. When developing, the toner particles 1 form a magnetic brush on a developing sleeve 2, with the magnetic layers 1*a* joined to one another at their exposed portions under the influence of the magnetic field of a magnetic brush developing unit. In this state, the magnetic layers 1*a* are aligned vertically on the sleeve 2 (see FIG. 1-(*a*)), with the result that the magnetic toner 1 has a relatively low resistivity in the direction from the sleeve 2 toward a latent image bearing member 3. In the course of development, the magnetic layers 1*a* of the toner particles 1 on the image bearing member 3 become magnetized to some extent. The magnetic attraction between the magnetic layers 1*a* acts to rotate the toner particles through about 90° on the member 3 (see FIG. 1-(*b*)), consequently moving the exposed portions of the magnetic layers 1*a* away from the surface of the image bearing members 3 and allowing the insulating resin portions 1*b* of the toner particles 1 to come into contact with the surface of the member 3 (see FIG. 1-(*c*)). As a result, the toner particles to be transferred from the image bearing member 3 to copy paper 4, e.g. by a corona discharge unit 5, have a relatively high resistivity in the direction from the member 3 toward the paper 4. The magnetic toner of the present invention therefore effects development with good results while permitting satisfactory transfer of toner images.

Figure 2:
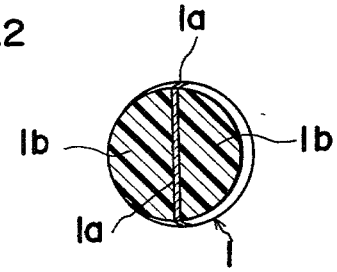
FIG. 2 is a sectional perspective diagram schematically showing an exemplary structure of magnetic toner particles of the invention.

Since the magnetic layer 1*a* concentrically containing a magnetic material within insulating resin portions 1*b* is included in the toner particle 1 in the form of a core as seen in FIG. 2, the magnetic toner of the invention has a much higher conveyability than the conventional magnetic toners. This enables the toner to contain an increased amount of resin, which gives the toner improved fixing properties.

The magnetic toner of this invention can be prepared, for example, by kneading a binder and a magnetic material in a ball mill along with a suitable solvent to effect full dispersion and obtain a magnetic coating composition, applying the composition to a resin film to form a magnetic layer, subjecting the layer to a magnetic field for orientation when so desired, coating the magnetic layer with a resin to form a resin layer, cutting and pulverizing the resulting sheet and screening the particles obtained.

The orientation treatment is achieved by subjecting the magnetic material layer within the resin to a magnetic field, the direction of which is parallel to the plane of said layer, before the layer is sealed in a fixed position within the resin.

Such orientation treatment is effective to align the magnetic material along said plane so as to decrease the resistivity of said layer in the direction along the plane of said layer. The magnetic toner in which the magnetic material had been subjected to such orientation treatment is easily magnetizable in the course of development by the magnetic field of the magnetic brush developing unit.

The orientation treatment can be omitted if desired.

The magnetic toner particles thus prepared have a core or sandwich structure in which the magnetic layer consisting mainly of a magnetic material is positioned between resin layers. Accordingly, the magnetic layer dividing the toner particles into the two resin portions is externally exposed on at least opposing portions of the surface of the particle.

Generally the magnetic layer is a resin layer containing iron particles or like magnetic material.

A preferred particle size is about 5 to 30 microns, however, these or other particle sizes can be employed depending on the application.

In addition to the magnetic material and resin of insulating properties used as the main components, the magnetic toner of the invention may further contain a coloring agent, chargeability controlling agent, etc. when so desired. Such additives are not particularly limited; those conventionally employed are usable.

Examples of the invention are given below.

EXAMPLE 1

One hundred parts by weight of PLIORITE AC (styreneacrylic copolymer: tradename of and manufactured by Goodyear Chemical Co., U.S.A.) was dissolved in 200 parts by weight of toluene, and 4 parts by weight of MITSUBISHI MA-100 (carbon black: tradename of and manufactured by Mitsubishi Chemical Industries Co., Ltd., Japan) was dispersed in the solution. The dispersion was applied to a stainless steel panel to form an insulating resin layer having a thickness of 10 μm when dried. The surface of the resin layer was charged by corona discharge and then caused to uniformly electrostatically attract thereto MAPICO BLACK BL-100 (magnetite: tradename of and manufactured by Chitan Kogyo Co., Ltd., Japan), whereby a 5 μm-thick magnetic layer was formed. The same pigmented resin solution as above was sprayed onto the magnetic layer to form an insulating resin layer 10 μm in thickness when dried. The resulting sheet was peeled off the stainless steel panel, pulverized and screened to obtain a magnetic toner 22 μm in average particle size.

The surface of ZnO paper bearing a latent electrostatic image thereon was brushed with a magnetic brush formed from the toner to develop the latent image to a toner image. The toner image was transferred to plain paper by intimately fitting the plain paper to the ZnO paper and subjecting the rear surface of the plain paper to corona discharge. Both the toner image formed on the ZnO paper and the toner image transferred to the plain were sharp and had a high density.

The latent image was developed by a magnetic brush developing unit having a developing sleeve with a rotatable magnet roller enclosed therein. The toner was found to be satisfactorily conveyable within the unit. The developing operation deposited a sufficient amount of toner on the image area of the ZnO paper. The toner image transfer efficiency achieved was as high as about 90%.

Comparative Experiment

PLIORITE AC: 100 parts by weight
MAPICO BLACK BL-100: 25 parts by weight
MITSUBISHI MA-100: 4 parts by weight The above ingredients were fully kneaded at 140° C. in a ball mill, and the mixture was solidified by cooling, pulverized and screened to prepare a magnetic toner 22 μm in average particle size.

The toner was tested in the same manner as in Example 1. The toner image transferred to plain paper was indistinct and had a low density with disturbances. The toner image developed on ZnO paper also had a low density. The transfer efficiency attained was as low as about 60%.

EXAMPLE 2

Twenty parts by weight of EPIKOTE 1002 (epoxy resin: tradename of and manufactured by Shell Chemical Co., U.S.A.) was dissolved in 100 parts by weight of acetone, and 100 parts by weight of CDX-660 (acicular magnetite: tradename of and manufactured by Toda Kyogo Co., Ltd., Japan) was dispersed in the solution to prepare a magnetic coating composition. The coating composition was applied to a 10 μm-thick film composed mainly of HYMER SBM-73 (styrene-acrylic resin: tradename of and manufactured by Sanyo Chemical Industries, Ltd., Japan). The coating was subjected to the usual orientation treatment, giving a 5-μm-thick magnetic layer. The magnetic layer was coated with a non-magnetic coating composition comprising 100 parts by weight of HYMER SBM-73 and 8 parts by weight of MITSUBISHI SA-100 to form an insulating layer 10

μm in thickness. The resulting sheet was cut, pulverized and screened to obtain a magnetic toner 20 μm in average particle size and having the structure shown in FIG. 2. The weight ratio of the insulating resin to the magnetic material of the toner was 4:1.

On the other hand, a non-magnetic toner 15 μm in average particle size was prepared from 100 parts by weight of PLIORITE AC and 10 parts by weight of MITSUBISHI MA-100 by kneading, solidifying, pulverizing and screening steps in the usual manner.

One hundred parts by weight of the magnetic toner and 15 parts by weight of the non-magnetic toner were mixed together to prepare a two-component developer. The developer was tested for copying operation with the use of a PPC including a magnetic brush developing unit, giving very sharp toner images at a high density. The toner images were fixed with outstanding results. The copier used was one comprising a magnetic brush developing unit including a stationary developing sleeve with a magnet roller rotatable at 1200 r.p.m., an electrophotographic photoconductive member chargeable to −750 V and movable at a peripheral speed of 8.7 m/sec., a corona discharge unit for transferring toner images and a heat roller unit for fixing toner images at 130° C.

Although the magnetic layer was formed on the insulating resin layer in Example 1 by subjecting the resin layer to corona discharge for charging and causing the resin layer to electrostatically attract the magnetic material to its surface, the magnetic layer can be formed alternatively by depositing Ni, Co-Ni alloy or like magnetic material on the surface of the resin layer by electroless plating or electroplating when so desired.

The following experiment was conducted to specifically substantiate the fact that the magnetic toners of the invention prepared in Examples 1 and 2, when developing, exhibit a low resistivity in the direction of the magnetic brush under the influence of a magnetic field. The results are also given below.

Reference Experiment

Figure 3:
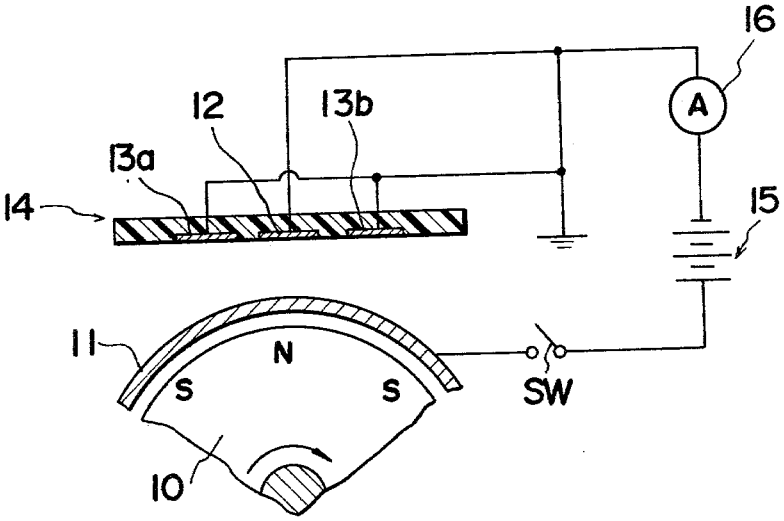
FIG. 3 is a fragmentary diagram schematically showing the device used for measuring the resistivity of the magnetic toner during development.

The experiment was conducted with the use of the device shown in FIG. 3 and comprising a stationary aluminum drum 11 housing a rotatable magnetic roller 10 and an electrode plate 14 opposed to the drum 11 and provided with a main electrode 12 and guard electrodes 13*a*, 13*b* grounded and connected together by an insulator. The magnetic toner was fed to the drum 11 for some time, and the magnetic roller 10 was then caused to stop rotating, while a switch SW was closed to form an electrical field between the electrode plate 14 and the drum 11 with a power supply 15. In this state, the current flowing between the electrode plate 14 and the drum 11 was measured by an ammeter 16. The resistivity of the toner was calculated from the measurement.

The magnetic toners of both Examples 1 and 2 were found to have a low resistivity of $10^7$ ohm-cm.

On the other hand, when the measurement was conducted in the above-mentioned state with the magnetic force of the roller 10 eliminated, namely without any magnetic field effect, both toners had a high resistivity of $10^9$ ohm-cm.

Given below are the conditions of the experiment.

| | | | |
|---|---|---|---|
| Magnetic roller: | diameter | 31 | mm. |
| | magnetic force | 750 | gauss. |
| | number of revolutions | 1000 | r.p.m. |
| | axial length | 200 | mm. |
| Drum: | diameter | 35 | mm. |
| Gap between drum and electrode plate: | | 1 | mm. |
| Widths of main and guard electrode: | | 10 | mm. |
| Power source voltage: | | 500 | V. |

Although the present invention has been fully described by way of example with reference to the attached drawings, it should be noted that various changes and modifications are apparent to those skilled in the art. Therefore unless otherwise such changes and modifications depart from the scope of the present invention, they should be construed as included therein.

What is claimed is:

1. A particulate magnetic toner for magnetic brush development of latent electrostatic images to toner images, which toner comprises:

a first and third portion consisting predominantly of an insulating, substantially non-magnetic resin and a second portion comprising a magnetic material sandwiched between said first and third portions, said second portion portion being exposed at least at opposed surfaces of the toner particles and said toner exhibiting a relatively low resistivity during development of said latent electrostatic images to toner images while exhibiting a relatively high resistivity during transfer of said toner images to a sheet for receiving said images.

2. The toner of claim 1 wherein said second portion is annularly exposed above the surface of said toner particle.

3. The toner of claim 1 having a particle size of from about 5 to 30 microns.

* * * * *